US006565169B1

(12) United States Patent
Moreno-Olguin et al.

(10) Patent No.: US 6,565,169 B1
(45) Date of Patent: May 20, 2003

(54) DOUBLE CRISPER DRAWER FOR A REFRIGERATOR

(75) Inventors: Arturo Moreno-Olguin, Nuevo León (MX); Moisés Sanchez-Guevara, Nuevo León (MX); Alfredo Cuevas-Morales, San Luis Potosí (MX); Mario Alberto Chavez-Rosas, San Nicolás de los Garza (MX); José Angel Avalos-Barcenas, San Luis Potosí (MX)

(73) Assignee: Comercial Acros WHirpool, S.A. de C.V., Nuevo Leon (MX)

( * ) Notice: Subject to any disclaimer, the term of this patent is extended or adjusted under 35 U.S.C. 154(b) by 73 days.

(21) Appl. No.: 09/706,520

(22) Filed: Nov. 3, 2000

(51) Int. Cl.[7] ..... A47B 96/00

(52) U.S. Cl. ..... 312/404; 312/270.3; 312/308; 312/348.3

(58) Field of Search ..... 312/404, 408, 312/410, 270.1, 270.3, 348.3, 308, 246, 291, 301

(56) References Cited

U.S. PATENT DOCUMENTS 2,103,885 A * 12/1937 Whalen ..... 312/404 X
2,300,885 A * 11/1942 Giffard ..... 312/408 X
2,496,750 A * 2/1950 Reeves ..... 312/410 X
3,729,242 A * 4/1973 Barney ..... 312/348.3 X
4,173,378 A 11/1979 Hanson et al.
4,729,613 A 3/1988 Tromble et al.
4,735,470 A 4/1988 Falk
5,437,503 A 8/1995 Baker et al.
5,749,241 A * 5/1998 Ryu et al. ..... 312/408 X
5,947,574 A 9/1999 Avendano

* cited by examiner

*Primary Examiner*—John G. Weiss
*Assistant Examiner*—Michael J. Fisher
(74) *Attorney, Agent, or Firm*—Abelman, Frayne & Schwab

(57) ABSTRACT

A double crisper drawer for a refrigerator includes a removable supporting structure, a first slidable tray, and a lower crisper drawer. The first slidable tray includes two side walls, a back wall, a front wall and a bottom wall. A first flange is projected outwardly on a top portion of the two side walls and back wall, the first flange being placed respectively on upper guide members located in the removable supporting structure, in order to be slidably moved with a backward and forward movement with respect to the removable supporting structure. The lower crisper drawer is also attached on lower guide members located in the removable supporting structure, the lower crisper being placed below the first slidable tray. The first slidable tray and the lower crisper drawer are independently slidably relative to one another, in relation to the removable supporting structure.

4 Claims, 3 Drawing Sheets

DOUBLE CRISPER DRAWER FOR A REFRIGERATOR

FIELD OF THE INVENTION

The present invention is related to crisper drawers and more specifically to a double crisper drawer for use in a refrigerator.

BACKGROUND OF THE INVENTION

Crisper drawers are well known in the art, which are provided in a bottom portion of a refrigerator for storing fresh fruits and vegetables. Normally, a crisper drawer comprises a slidable compartment for storing the fresh fruits and vegetables and a removable cover that is located on the upper part of the compartment. The removable cover is attached on supports in the form of slots or ribs, which are integrally molded within each side wall of a refrigerator liner. The removable cover is made of tempered glass, which also acts as a shelf for additionally support other items that are being refrigerated.

However one of the disadvantages of the previous art, is that the slidable compartment is used to store any type and size of fruits and vegetables, so that, when a smaller vegetables or fruits i.e. peppers, peas, garlics, string-beans, small-carrots, lemons, asparagus, etc. are required by the consumer, he need to remove all the bigger vegetables or fruits to extract the small pieces.

Different developments for storing food within the refrigerator have being carried out, for example, the U.S. Pat. No. 4,173,378 issued to Hanson, et al, on Nov. 6, 1979, is related to a removable sealed storage drawer and a support cover for installation in various locations in the refrigerator cabinet. In that arrangement, a supporting frame and cover panel assembly are adapted for slidably and sealingly supporting a food storage drawer in a generally airtight sealed environment for extended food storage.

The U.S. Pat. No. 4,729,613, issued to Ralph D. Tromble et al on Mar. 8, 1988, is related to a pan assembly for use in a household refrigerator fresh food compartment comprising a removable rigid unitary frame having two side plates secured within the fresh food compartment to support the frame, a front horizontal support member and a rear horizontal support member rigidly attached to and spanning the distance between the side plates. There are two pans of different widths and having an open top with outwardly depending flanges along the side walls at the top of the pans. Three slide members with horizontal channels receive the pan flanges and support the pans thereon. The slide carriers are supported on the rear and front support members of the frame and are slidable along and removable from the support members. A removable cover is supported on the front and rear support members of the frame above the slide carriers.

The U.S. Pat. No. 4,735,470 issued to Donald G. Falk on Apr. 5, 1988, is related to a refrigerator food storage compartment having a shelf assembly, including a pair of vertically extending laterally spaced rail members. A shelf is supported on a pair of horizontally extending arm members which are positioned on the rail members. Carried on the shelf assembly is a secondary food storage arrangement supporting a plurality of containers. The arm members include confronting grooves arranged below the shelf. Slidably arranged in the grooves is a container supporting frame which includes pairs of confronting flanges supporting the containers. Forward travel of the container supporting frame relative to the shelf assembly provides access to the containers. The front portion of the frame includes a front opening through which the containers may be removed while the container supporting frame remains positoned below the shelf.

The U.S. Pat. No. 5,437,503 issued to Phillip D. Baker et al on Aug. 1, 1995, is referred to a refrigerator food storage compartment having a shelf assembly, including a pair of vertically extending laterally spaced rail members. A shelf is supported on a pair of horizontally extending arm members which are positioned on the rail members. Carried on the shelf assembly is a secondary food storage arrangement supporting a plurality of containers. The arm members include confronting grooves arranged below the shelf. Slidably arranged in the grooves is a container supporting frame which includes pairs of confronting flanges supporting the containers. Forward travel of the container supporting frame relative to the shelf assembly provides access to the containers. The front portion of the frame includes a front opening through which the containers may be removed while the container supporting frame remains positoned below the shelf.

Finally, The U.S. Pat. No. 5,947,574 issued to Jose G. Avendano on Sep. 7, 1999, is related to a refrigerator shelving assembly includes a universal frame adapted to support various different shelving units thereon. The frame is defined by interconnected front, rear and side frame members, and preferably a pair of intersecting cross frame members. Each of the frame members, in at least an opposing pair of the front, rear and side frame members, is provided with a ledge portion located in a first plane and a trough portion arranged below the first plane at a position between the ledge portions and a respective cross frame member. Each of the cross frame members has an upper surface also located in the first plane. With this construction, the frame can universally support various types of shelving units, including a basic shelf constituted by a plate of glass or a premium shelf formed by encapsulating an annular portion of a plate of glass by a rim defining element that extends below a plane defined by the glass plate, upon the cross frame members and either the ledge or trough portions of the shelving assembly. Furthermore, the frame members can carry guide rails for slidably supporting one or more refrigerator bins below a selected shelving unit.

As can be seen of the previous art, such arrangements are related to food storage drawers for extend the food storage, and also are related to pan assemblies mounted in an unitary frame. However, they do not contain an additional compartment or tray conjointly with the main compartment, with the object of store smaller vegetables or fruits.

Moreover, certain types vegetables should be stored at a high relative humidity, while others such as fruit should not, so, with this invention, will be possible to separate some fruits and vegetables from the others with respect to size and humidity.

In accordance with the above the present invention is related to a double crisper drawer for a refrigerator, which allows the easy removal of smaller fruits and vegetables placed on a first tray located on the upper part of a lower crisper drawer. A supporting structure supports both first tray and lower crisper drawer in order that these can be independently slidable one of the other. So, the first tray and the lower crisper drawer can be independently removed, when the front door of the refrigerator is opened, thereby providing to the user access independently to smaller fruits or vegetables or a larger fruits or vegetables.

SUMMARY OF THE INVENTION

A first objective of the present invention is to provide a double crisper drawer for a refrigerator, which includes a first slidable tray for the storage of smaller fruits or vegetables.

Is other objective of the present invention, to provide a double crisper drawer for a refrigerator, which contains a lower crisper drawer for storing larger fruits or vegetables.

Another objective of the present invention, is to provide a double crisper drawer for a refrigerator, which is placed on a supporting structure that is attached on supports in the form of slots or ribs, which are integrally molded within each side wall of a refrigerator liner.

An additional objective of the present invention is to provide a double crisper drawer for a refrigerator, wherein the upper part of said supporting structure also acts as an additional support for other items that is being refrigerated.

These and other objectives and additional advantages of the present invention will be made evident to experts in the field in the following detailed description of the invention, which will make reference to a specific embodiment of the invention in an illustrative, but not limiting sense.

DESCRIPTION OF THE PREFERRED EMBODIMENT

Figure 1:
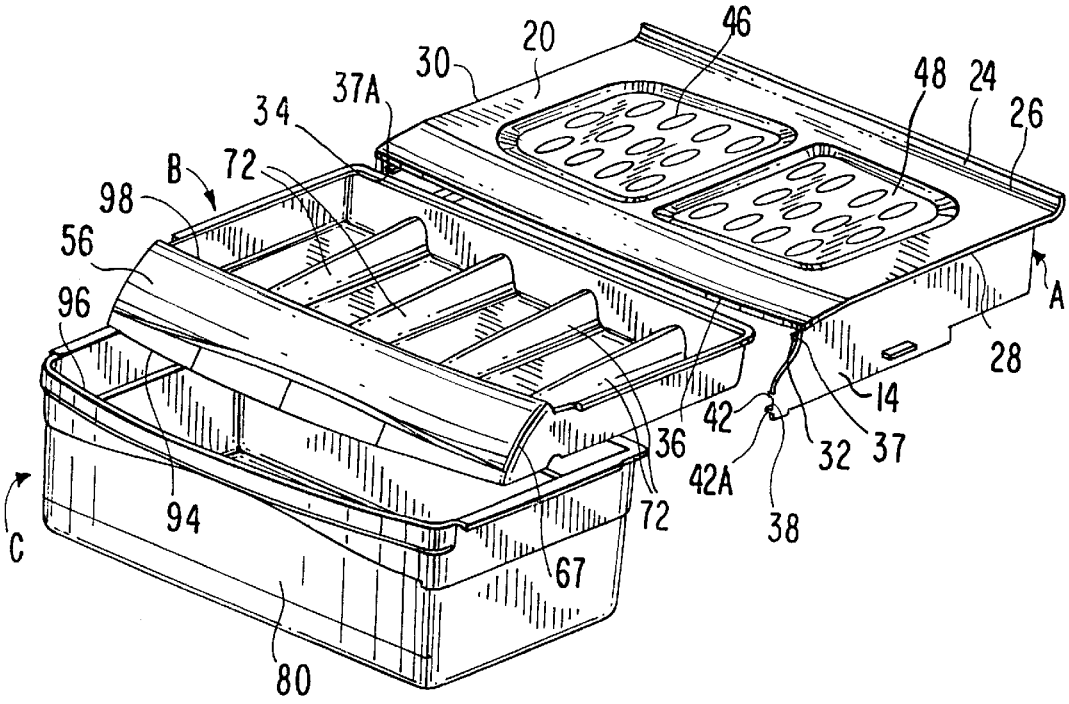
FIG. 1 is a perspective view of the double crisper drawer in accordance with the present invention.
Figure 2:
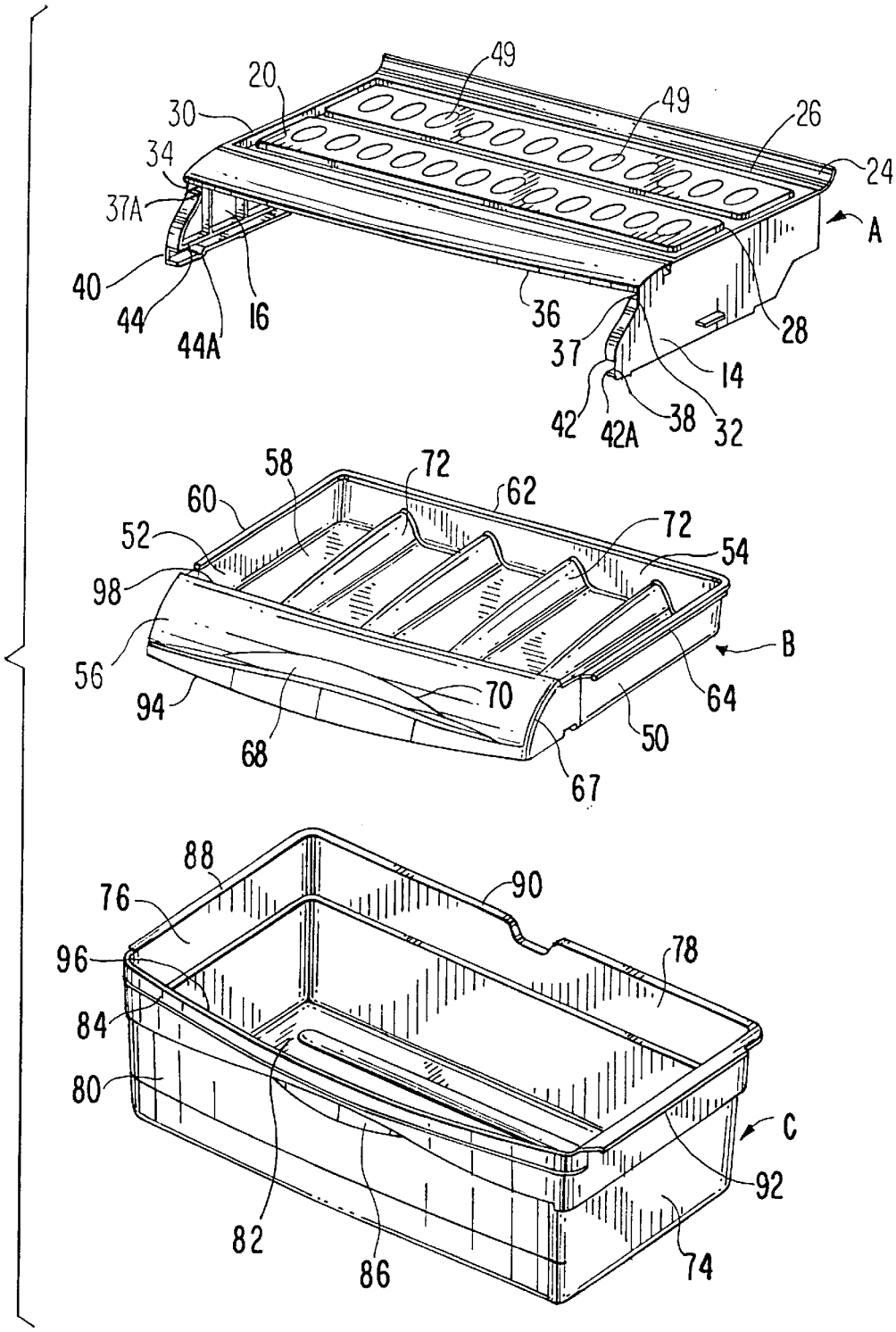
FIG. 2 is an exploded perspective view of the double crisper drawer in accordance with the present invention; and, FIG. 3 is a lateral view of the double crisper drawer showed in FIG. 1.

Making now reference to FIGS. 1 and 2, the double crisper drawer of the present invention comprises a supporting structure A that includes two side wall 14 and 16, a rear wall 18 (FIG. 3) and a top wall 20. The top wall 20 having a rear curved plate section 24, in a rear portion 26 of the top wall 20, which is adapted to a rear wall of a refrigerator liner (not shown), and side portions 28 and 30 that are outwardly projected as flanges to be placed on supports within each side wall of a refrigerator liner (not shown).

Figure 3:
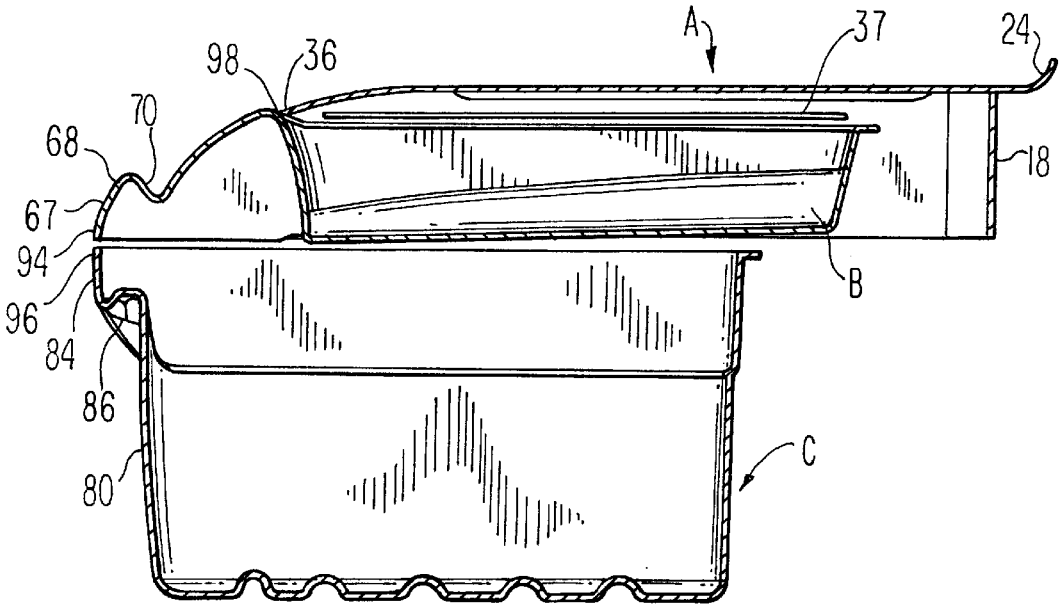

The side walls 14 and 16 including respectively, an upper guide member 32 and 34, that projects inwardly in a lateral way from a front portion 36 to the rear portion 26 of the top wall 20. The upper guide members 32 and 34 comprising a first rail 37, 37A, that is placed in a parallel path, with relation to the lower face of the top wall 20. A lower guide member 38 and 40 formed of two rails 42, 42A, and 44 and 44A, which are also projected inwardly from the front portion 36 to the rear portion 26 of the top wall 20. The top wall 20 including two decorative plates 46, 48 (FIG. 1) or a plurality of decorative circles 49 (FIG. 3).

A first slidable tray B for the storage of smaller fruits or vegetables, which is supported by supporting structure A, through of the upper guide members 32 and 34. The first slidable tray B including side walls 50 and 52, a back wall 54, a front wall 56 and a bottom wall 58. Flanges 60, 62 and 64 are extended on the top portions of the side walls 50, 52 and back wall 54. The flanges 60 and 64 being placed respectively on the upper guide members 32 and 34, in order to the first slidable tray B can be moved with a backward and forward movement with respect to the supporting structure A. The front wall 66 comprises a curved section 67 projected outwardly, which is provided with a handle 68 to allow the user to grip the tray B for moving it with the backward and forward movement.

The handle 68 comprises a recess 70 on the top portion in order to allow the user to put his/her fingers over the upper part of the handle 68.

With reference to the bottom wall 58 of the slidable tray B, comprises a plurality of divider walls 72, which are formed at spaced intervals across the width of the bottom wall 58, extending between the front wall 66 and rear wall 54, and substantially parallel to side walls 50 and 52. The divider walls 72 maintaining the smaller fruits or vegetables in ordered rows to help maintain an ordered appearance of the products.

Finally, the lower crisper drawer C for storing larger fruits or vegetables is of a rectangular configuration, which includes two side wall 74 and 76, a rear wall 78, a front wall 80 and a bottom wall 82. The top part of the front wall 80 having a curved section 84 projected outwards forming a lower recess 86 to allow the user put the fingers to pull or push the crisper drawer C. The upper periphery of the two side wall 74 and 76 and the rear wall 78 having formed flanges 88, 90 and 92 that are extended outwardly. The flanges 88 and 92 being placed respectively between the rails 44 and 44A and 42, 42A of the double slide cover A. So, the lower crisper drawer C can be moved independently with a backward and forward movement on the supporting structure A.

As can be seen in the FIG. 3, the lower part 94 of the curved section 67 of the front wall 56 and, the top section 96 of the curved section 84 of the crisper drawer C are placed in coincidence one with the other when the lower crisper drawer C and the slidable tray B are in a closed position.

In the same way, an upper section 98 of the curved section 67 of the front wall 56 of the slidable tray B is located in coincidence with the front section 36 of the top wall 20.

As can be seen from the embodiment above described, a double crisper drawer for use in a refrigerator is showed for storing smaller and larger fruits or vegetables. However, it must be understood that the invention should not be limited to the embodiment above described, and it will be apparent to the experts in the field that other diverse embodiments could be implemented, along with alternative embodiments which will be clearly contained within the spirit of the present invention which are claimed in the following claims.

We claim:

1. A double crisper drawer for a refrigerator comprising:

a removable supporting structure, said removable supporting structure having:

two side walls;

a rear wall;

a top wall;

upper guide members projected inwardly in a top section of each side walls, which are extending in parallel relation from a front portion to a rear portion of the top wall;

lower guide members projected inwardly in a lower section of each side walls, which are extending in parallel relation from a front portion to a rear portion of the top wall; and an outwardly projected flange located about of each side wall, said outwardly projected flange being placed on supports of a refrigerator liner for retaining said removable supporting structure;

a first slidable tray, said first slidable tray having:

two side walls;

a back wall;

a front wall;

a bottom wall;

a first flange projected outwardly about of the two side walls and back wall, said first flange being positioned on said upper guide members of said removable supporting structure, in order to allow said first slidable tray to be independently moved with a backward and forward movement with respect to the removable supporting structure;

wherein said front wall of said first slidable tray including an upper recess on a top portion; and a lower crisper drawer, said lower crisper drawer being placed in the lower part of said removable supporting structure, and being located below of said first slidable tray, said lower crisper drawer having:

two side walls;

a rear wall;

a front wall;

a bottom wall; and a second flange projected outwardly about of the side walls and back wall of said lower crisper drawer, said second flange being placed on said lower guide members of said removable supporting structure;

wherein said front wall of said lower crisper drawer includes a lower recess on a lower portion, said lower recess being formed in an inverted position in relation to said upper recess.

2. The double crisper drawer for a refrigerator as claimed in claim 1, wherein the bottom wall of the first slidable tray includes a plurality of divider walls, said divider walls being formed at spaced intervals across the width of the bottom wall, extending between the front wall and rear wall, and substantially parallel to said side walls.

3. The double crisper drawer for a refrigerator as claimed in claim 1, wherein the upper guide members are two rails.

4. The double crisper drawer for a refrigerator as claimed in claim 1, wherein the lower guide members are two rails.

* * * * *